United States Patent [19]

Yotsuya

[11] Patent Number: 4,749,998

[45] Date of Patent: Jun. 7, 1988

[54] ANTENNA DEVICE FOR AN AUTOMOBILE

[75] Inventor: Hiroshi Yotsuya, Aichi, Japan

[73] Assignee: Toyota Jidosha kabushiki Kaisha, Toyota, Japan

[21] Appl. No.: 866,909

[22] Filed: May 27, 1986

[30] Foreign Application Priority Data

May 30, 1985 [JP] Japan ..... 60-80038[U]

[51] Int. Cl.[4] ..... H01Q 1/02

[52] U.S. Cl. ..... 343/713; 343/712

[58] Field of Search ..... 343/713, 715, 711, 712, 343/714

[56] References Cited

U.S. PATENT DOCUMENTS 4,063,247 12/1977 Sakurai et al. ..... 343/713
4,160,977 7/1979 Davis ..... 343/713
4,260,989 4/1981 Ishii et al. ..... 343/713
4,491,844 1/1985 Tsuchie et al. ..... 343/713

*Primary Examiner*—William L. Sikes
*Assistant Examiner*—Doris J. Johnson
*Attorney, Agent, or Firm*—Oblon, Fisher, Spivak, McClelland & Maier

[57] ABSTRACT

An antenna device for an automobile comprises at least one feeding part to be connected to an antenna feeder line, which is provided near the front edge or the rear edge of a side window panel at the rear part of the automobile, a first antenna strip connected to the said feeding part so as to extend in the substantially longitudinal direction of the said window panel, and a second antenna strip in which a bent portion is formed connected to the first antenna strip of the feeding part so as to extend along the first antenna strip.

5 Claims, 5 Drawing Sheets f=90 MHz f=95 MHz f=108 MHz f=173 MHz f=185 MHz f=213 MHz f = 485 MHz

MEAN 36.5
MIN 19.1
MAX 41.1
Directivity 17.4 f = 575 MHz

MEAN 31.6
MIN 20.8
MAX 37.6
Directivity 10.8 f = 755 MHz

MEAN 22.5
MIN 8.6
MAX 29.6
Directivity 13.9

ANTENNA DEVICE FOR AN AUTOMOBILE

BACKGROUND OF THE INVENTION

1. Field of the Invention

The present invention relates to an antenna device for an automobile. More particularly, it relates to such device useful for an automobile mounting a TV receiver.

2. Description of Prior Art

A glass antenna system in which antenna strips arranged in a desired pattern are provided in a window glass of an automobile has been widely used as an antenna device for an automobile. The antenna device of this kind is tuned in to AM and FM broadcast wave bands so that excellent sensitivity is given to receive radio broadcast waves.

For a television to be mounted on an automobile, which has come recently, there has been a demand of receiving TV broadcast waves by an antenna device for inclusive use for a radio receiver. It was, however, impossible to receive the TV broadcast waves since the conventional antenna device was tuned in to only the radio broadcast waves. Accordingly, an antenna device for inclusive use for a television was required for a TV receiver to be mounted on an automobile in addition to a radio receiver.

Heretofore, there has been proposed an antenna device for inclusive use for the television receiver having such construction that a plurality of rod-like antenna elements are attached to the roof of an automobile to receive TV broadcast waves in a broad band region.

However, the proposed antenna device had such problems that the antenna elements on the car roof constitute external projections which were dangerous to foot passengers and they produced a blowing sound during high-speed running. Further, the antenna elements were easily touched by others at a parking time and easily came into contact with the ceiling of a garage or trees to result in breakage of the antennas.

To resolve the above-mentioned problems, it can be considered that an antenna strip for receiving the TV broadcast waves is installed in a rear window panel made of glass or a resinous material. However, the rear window panel is generally provided with heating strips for defrosting to keep the backward sight clear when it is cold. In this case, it is necessary to arrange the antenna strip in the rear window panel without causing interference by the heating strips.

The rear window panel is required to give clear backward sight. In addition, it is undesirable that both the heating strips and the antenna strip for the TV broadcast waves are installed in the rear window panel from the viewpoint of its appearance. Even though the antenna strip for the TV broadcast waves is disposed in the rear window panel, a space for the heating strips is limited whereby a sufficient by clear backward sight can not be provided when it is cold. This inevitably causes limitation of a space for arrangement of the antenna strip.

On the other hand, for an antenna for the TV receiver, a fairly large space is required in order to give good sensitivity of receiving the TV broadcast waves.

Accordingly, the limited space for the antenna makes maintenance of the excellent radio wave receiving function difficult. Further, in the automobile having the rear window panel in which an antenna strip for receiving radio broadcast waves is installed, it is practically impossible to add the antenna for the TV broadcast waves in the rear window panel.

SUMMARY OF THE INVENTION

It is an object of the present invention to provide an antenna device for an automobile providing excellent function for receiving TV broadcast waves in a broad frequency band region without causing the antenna device from outwardly projecting from the automobile body and limiting sight of a driver from the interior of the automobile, by installing an antenna strip having a desired pattern in the rear side window panel at the rear part of the automobile which is not so important than the rear window panel to keep the sight from the interior of the automobile.

The foregoing and the other objects of the present invention have been attained by providing an antenna device for an automobile which comprises at least one feeding part to be connected to an antenna feeder line, which is provided near the front edge or the rear edge of a side window panel at the rear part of the automobile, a first antenna strip connected to the feeding part so as to extend in the substantially longitudinal direction of the side window panel; and a second antenna strip in which a bent portion is formed connected to the first antenna strip or the feeding part so as to extend along the first antenna strip.

In the present invention, the side window panel may be of any type such as a fixed window type, a hinged window type, a slidable window type, as long as it is located at a side or the sides of the rear part of the automobile. However, the fixed window type or the hinged window type panel is preferably used from the viewpoint of wiring of the antenna feeder line to be connected to the feeding part. The feeding part may be provided at any position as long as it is located at or near the front edge portion or the rear edge portion of the side window panel. It is, however, desirable that it is arranged near the lower side of the side window panel in consideration of the wiring operation of the antenna feeder line.

It is not always necessary to arrange the antenna strip perpendicular to the lower side of the side window panel, but it may be arranged in such a manner that it is inclined to some extent; the portion at its free end side of the antenna strip is bent and one or more additional antenna strips are provided in the permissible range in appearance and signal receiving characteristics.

The length of the antenna strip can be selected as desired depending on broadcast wave band regions to be received. However, it is necessary that for a high frequency band region, the effective length as an antenna is given by the first antenna strip and for low frequency band region, the effective length as the antenna is given by the both antenna strips. With respect to the bent portion of the second antenna strip, the number and the dimension of it may be changed as desired as long as the phases of signals received in each of the antenna strips are matched in at least low frequency band region and the bent portion functions as a reactance element to the second antenna strip.

BREIF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

In the following, preferred embodiments of the present invention will be described in detail with reference to the accompaning drawings.

Figure 1:
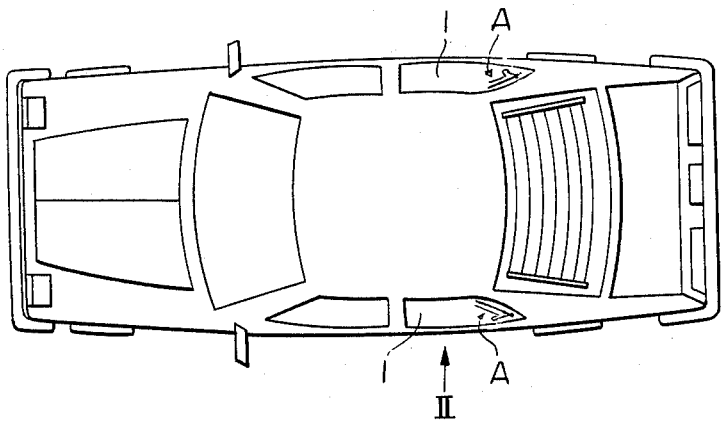
FIG. 1 is a plane view of an automobile mounting antenna devices according to an embodiment of the present invention.
Figure 2:
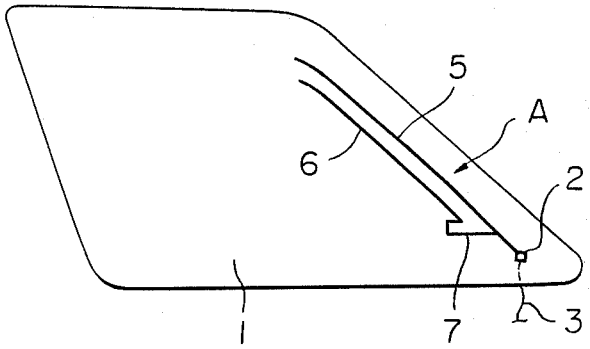
FIG. 2 is a view showing the detail of one of the antenna device in FIG. 1, which is viewed from the direction of a numeral II in FIG. 1.

FIGS. 1 and 2 show a first embodiment of the present invention. An antenna device is provided at each of the right and left side window panels 1 (hereinbelow referred to simply as a window panel) of the rear part of an automobile. Each of the antenna devices comprises an antenna line arrangement A having a desired pattern which is formed on a surface of the window panel 1 by print-baking a conductive paste such as a silver paste containing glass frit and a feeding part 2 positioned near the lower side of the window panel 1 to be connected to the antenna line arrangement A. An antenna feeder line 3 is provided to connect the feeding part 2 to a television receiver (not shown). A diversity reception system is constituted by selectively switching the antenna devices at the right and left window panels by a switching means (not shown).

In the embodiment, the antenna line arrangement A is constituted by a first antenna strip 5 extending in the substantially longitudinal direction from the feeding part 2 along the rear edge of the window panel 1 and a second antenna strip 6 branched from the first antenna strip 5 and extending along it. A ⊐-shaped bent portion 7 is formed in the second antenna strip 6 at a position near the branched portion. The first antenna strip 5 has a linear portion extending in the substantially longitudinal direction of the window panel 1 and the entire length of the first antenna strip is determined to be in a range from about 250 mm to 500 mm to assure an effective length in a high frequency band region in TV broadcast VHF wave band region (for instance, 170–222 MHz). The portion other than the bent portion 7 of the second antenna strip 6 is substantially linear and the length of the second antenna strip is determined to be in a range from about 150 mm to 350 mm to assure an effective length in a low frequency band region in the TV broadcast VHF wave band region (for instance, 90–108 MHz). The length and the width of the bent portion 7 is so determined as to match the phase of signals received by the antenna strips 5, 6 in the low frequency band region. The bent portion 7 is adapted to function as a reactance element with respect to the second antenna strip in the high frequency band region.

Figure 3:
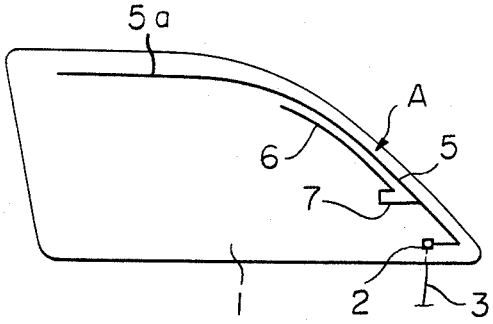
FIGS. 3 to 8 are respectively diagrams showing modifications of the antenna device according to the present invention.
Figure 4:
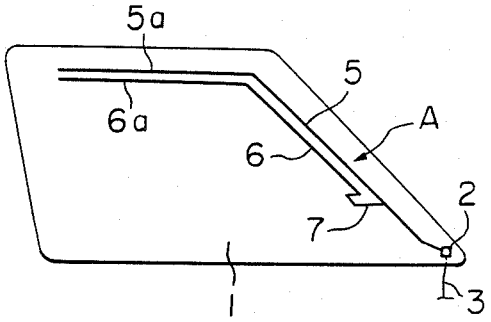
Figure 5:
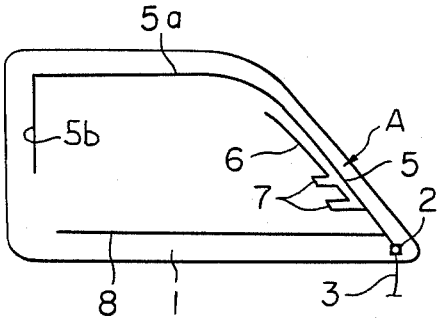

In the above-mentioned embodiment, when the dimension of the widow panel 1 in its longitudinal direction is insufficient to assure the effective length of the antenna strips, the portion at the side of the free end of the antenna strip 5 or 6 which has the insufficient effective length is bent along in the substantially lateral direction of the window panel 1 so that the insufficient effective length is compensated by a bent portion 5*a* or 6*a* as shown in FIGS. 3 and 4. When the effective length is still insufficient, the free end portion of the bent portion 5*a* is again bent in the substantially longitudinal direction of the window panel 1 so that the insufficient effective length is compensated by a bent portion 5*b* as shown in FIG. 5.

Further, by determining the distance between the antenna strips 5, 6 to be in a predetermined range (for instance, 10 mm–50 mm), one of the antenna strips functions as a reflector or a wave guide device with respect to the other whereby directivity characteristic can be improved by effectively receiving radio waves from an area of low diversity.

Figure 6:
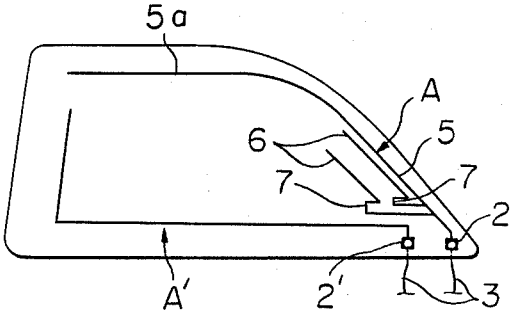

Adjustment of the reactance in the bent portion 7 may be carried out by changing the length and the width of the bent portion or by forming a plural number of the bent portions 7. Matching of an input impedance with a road impedance may be carried out by, for instance, adding an auxiliary antenna strip 8 to the first antenna strip 5 as shown in FIG. 5, or by providing a plural number of the second antenna strips as shown in FIG. 6.

In the above-mentioned embodiment, a two-diversity reception system is constituted by the antenna devices provided in the right and left rear side window panels 1. Accordingly, an optimun signal receiving capability can be obtained by combining or selecting the two antenna devices.

In the above-mentioned embodiment, description has been made as to use of a single feeding part 2 to which the antenna line arrangement A having a desired pattern is connected. However, an additional feeding part 2′ may be provided near or apart from the feeding part 2 and a separate antenna line arrangement A′ having a desired pattern may be connected to the feeding part 2′ so as not to narrow the sight of the window panel 1. Such construction enables the signal receiving characteristics of the antenna line arrangements A, A′ to be remarkably different. Accordingly, broadcast waves in a broad frequency band regions can be effectively received by sharing the signal frequency bands by the antenna line arrangements A, A′ having the different signal receiving characteristics. Further, efficiency of signal reception can be improved by employing the two-diversity receipt system constituted by the both antenna line arrangements A, A′, or employing a four-diversity receipt system which is constituted by each of the antenna devices in the right and left window panels 1. In addition, a diversity receipt system may be formed by the combination of the antenna device installed in the side rear window panel 1 and another antenna system mounted on another part on the automobile.

The function of the embodiment having the construction that the second antenna strip is connected to the first antenna strip through the bent portion is as follows.

In the high frequency band region, a reactance component of the bent portion is inserted between the antenna strips so that an impedance of the first antenna strip with respect to the second antenna strip becomes extremely large. Accordingly, the second antenna strip is substantially separated from the first antenna strip, and only the first antenna strip connected to the feeding part functions as an antenna. When the first antenna strip is formed corresponding to the effective length to function as an antenna for the high frequency band region, the connecting point of the first antenna strip to the bent portion becomes a reflecting point for a stationary wave, whereby the broadcast wave in the high frequency band region can be certainly received by the first antenna strip. On the other hand, in the low frequency band region in the signal receiving band region, the antenna strips are mutually brought into a short-circuit condition by the matching effect of the bent portion. Accordingly, the antenna strips function as one piece antenna. If the sum in length of the both antenna strips is determined to be correspond to the effective length of the antenna in the low frequency band region, the broadcast wave in the low frequency band region can be certainly received by the both strips. With the antenna pattern as described above, each of the antenna strips optimally functions depending on the signal frequency band region by means of the bent portion. Accordingly, sensitivity of the antenna strips can be effectively maintained even though the antenna are placed closer. Accordingly, even when the surface area of the side window panel at the side of the rear part of the automobile is relatively small, the antenna device of the present invention can effectively function by providing a desired antenna pattern in the side window panel.

In the following, two examples of the antenna device according to the present invention and its performance of signal reception of the device will be described.

(EXAMPLE 1)

An antenna device as shown in FIG. 2 was prepared. Namely, a feeding part 2 is provided at a position near the rear edge of a window panel 1 and 40 mm aparted from the lower side of the panel 1; a first antenna strip 5 having a length of 420 mm is extended from the feeding part 2 and 55 mm aparted from the rear edge of the window panel 1; a second antenna strip 6 is branched from the lower part of the first antenna strip at a position 105 mm aparted from the lower edge of the window panel 1; a bent portion 7 is formed by bending the second antenna strip 6 at lengthes of 70 mm, 25 mm and 60 mm from the branched portion; a linear portion of 300 mm of the second antenna strip extends upward from the bent portion 7 at a distance 30 mm from the first antenna. Two antenna devices each having two-diversity reception system and the antenna pattern as shown in FIG. 2 were mounted on the rear side window panels of an automobile. The automobile was turned from a reference position by 360° and a TV broadcast wave (a horizontally polarized wave) of a predetermined frequency was transmitted in an uniform electric field of 60 dB $\mu$/m from the side of the reference position to measure a signal receiving sensitivity level (Bb$\mu$) corresponding to each position of the automobile. As a result, in the directivity measured, it was revealed that desired sensitivity can be obtained in the TV broadcast VHF wave band region and a value of the sensitivity was extremely small, and extremely sharp directivity was not given in the TV broadcast UHF wave band region even though the sensitivity was slightly low. Accordingly, it is understood that the antenna device functions as an antenna of non-directivity which has relatively stable sensitivity in the entire region of the TV broadcast wave bands. Further, it is possible to increase the sensitivity by adding an amplifier.

(EXAMPLE 2)

Figure 7:
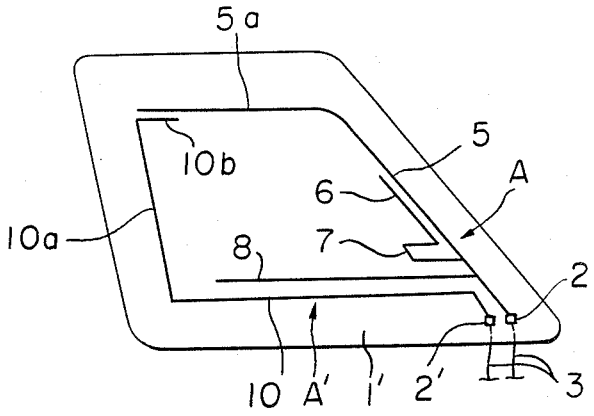
Figure 8:
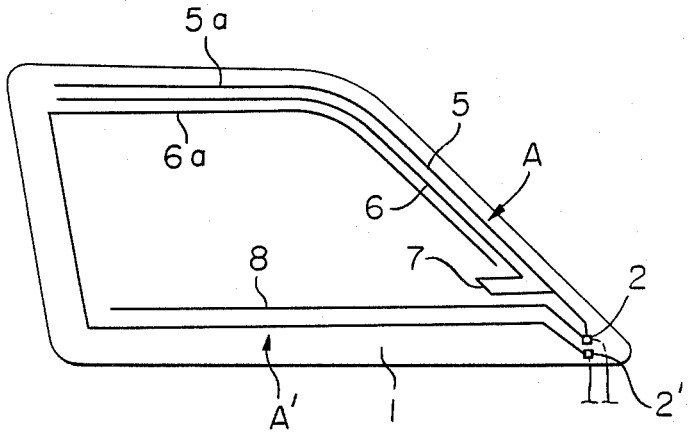
Figure 9:
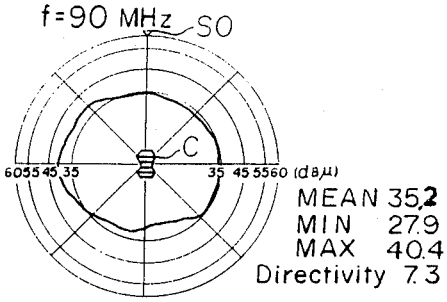
FIGS. 9*a* to 9*i* are respectively diagrams showing direction characteristics in several frequency band regions of the antenna device explained in Example 2.
Figure 9:
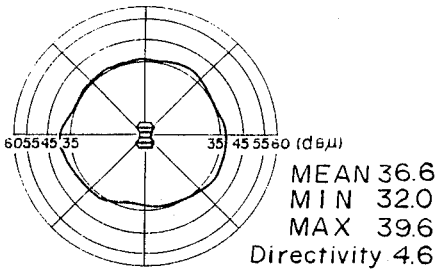
Figure 9:
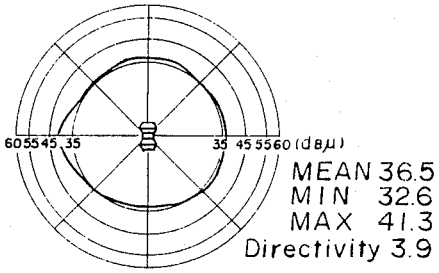
Figure 9:
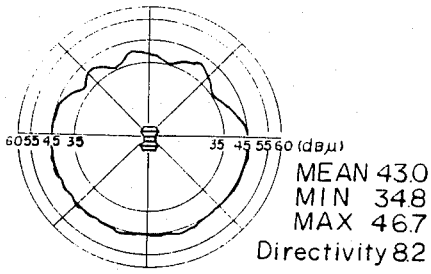
Figure 9:
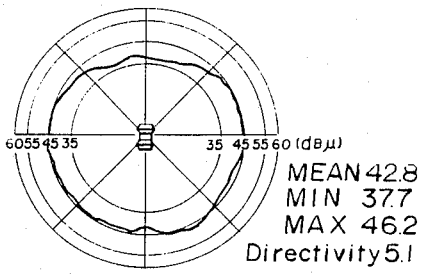
Figure 9:
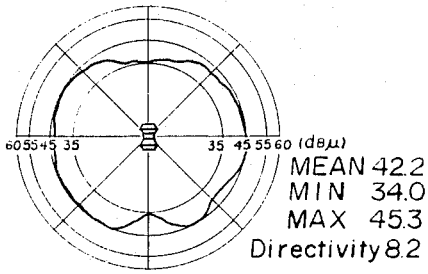
Figure 9:
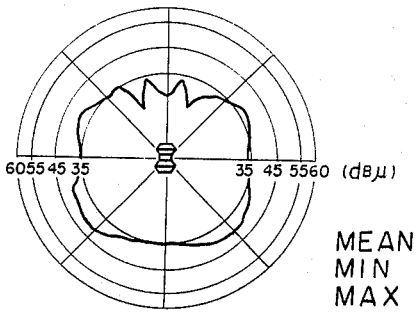
Figure 9:
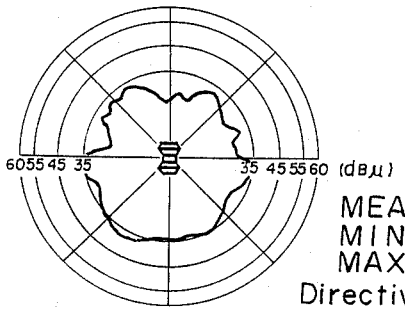
Figure 9:
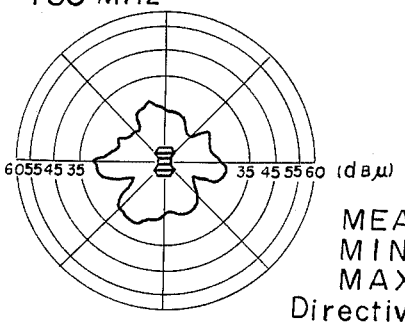

An antenna device as shown in FIG. 7 was prepared. Namely, two feeding parts 2, 2' are provided near the rear edge of the window panel 1 and at a position 40 mm aparted from the lower side of the panel 1. For an antenna line arrangement A connected to the feeding part 2, a first antenna strip 5 having the entire length of 650 mm is provided with a bent portion 5*a* (having a linear portion of 195 mm) which is extended 55 mm aparted from the rear edge and 70 mm aparted from the upper edge of the window panel 1. An anxiliary antenna strip 8 (having a length of 340 mm) is connected to the first antenna strip 5 at a position 105 mm aparted from the lower side of the window panel 1. A second antenna strip 6 is branched from the first antenna strip 5 at a position 130 mm aparted from the lower side of the window panel 1. The second antenna strip 6 has an upwardly extending linear portion of 150 mm long which is contiguous to a bent portion which is formed by bending the second antenna strip at lengthes of 70 mm, 25 mm and 60 mm. The linear portion of the second antenna strip is 10 mm aparted from the first antenna strip 5.

The other antenna line arrangement A' connected to the other feeding part 2' comprises a single antenna strip 10 whose entire length is 780 mm. The antenna strip 10 has two bent portions 10*a*, 10*b* of 325 mm and 50 mm respectively. The bent portion 10*a* is arranged 80 mm aparted from the lower side and the front edge of the window panel 1 respectively. The bent portion 10*b* is 10 mm aparted from the first antenna strip 5.

The antenna device having the four-diversity reception systems and having the antenna pattern as shown in FIG. 7 was installed in each of the right and left rear side window panels of an automobile, and directivity characteristic of the antenna devices was measured for several frequency band regions under the same condition as the example 1. Results as shown in FIGS. 9*a* to 9*i* were obtained. In each characteristic diagram showing directivity, a symbol C indicates the automobile, a symbol SO represents a reference position, "MEAN" refers to an average signal reception sensitivity level, "MIN" refers to the minimum signal reception sensitivity level, and "MAX" refers the maximum signal reception sensitivity level and "directivity" refers to a value obtained by substracting the minimum signal reception sensitivity level from the average signal reception sensitivity level.

In the above-mentioned embodiments, description has been made as to the antenna device used for receiving the TV broadcast waves. However, the antenna device can be used for an antenna device for receiving the radio broadcast waves.

In the antenna device for an automobile according to the present invention, the antenna line arrangement having a desired pattern is provided in the side window panel mounted on the rear side part of the automobile. Accordingly, the antenna device does not constitute an outer projection whereby safe and comfortable running of the automobile can be obtained and a trouble of breakage of the antenna can be minimized.

Further, in accordance with the present invention, there are a plurality of antenna strips at least of which are provided with a bent portion for matching the phase of signals in a low band region. Accordingly, a desirable radio wave band region is received by an antenna strip, whereby radio waves in a broad band region can be certainly received and good signal reception as the antenna device for the automobile can be provided.

In addition, the antenna pattern formed in the antenna device is arranged near the front edge or rear edge of the window panel. Accordingly, sight of the driver in the side direction is not limited by the antenna pattern whereby a sufficient sight from the interior of the automobile is obtainable.

What is claimed is:

1. An antenna device for an automobile which comprises:

at least one feed point to be connected to an antenna feeder line, which is provided near one of the side edges of a side window panel without any heating elements;

a first antenna strip connected to said feed point so as to extend in the substantially longitudinal direction of said side window panel;

and a second antenna strip in which a bent portion is formed connected to said first antenna strip so as to extend along in a closely spaced parallel relationship said first antenna strip.

2. The antenna device for an automobile according to claim 1, wherein the free end portion of said first antenna strip is bent and extended in the substantially lateral direction of said side window panel.

3. The antenna device for an automobile according to claim 1, wherein said first and second antenna strips function as antennas for receiving TV broadcast waves.

4. The antenna device for an automobile according to claim 1, wherein said at least one feed point and said first and second antenna strips are respectively provided in right and left side window panels of said automobile, in which a diversity reception system is constituted by combination or selection of said antenna devices in said right and left window panels.

5. The antenna device for an automobile according to claim 1, wherein said first and second antenna strips are are separated by a space of from 10 mm to 50 mm.

* * * * *